US005571400A

United States Patent [19]

Karcher

[11] Patent Number: 5,571,400

[45] Date of Patent: Nov. 5, 1996

[54] PROCESS FOR THE ELECTROSYNTHESIS OF ALDEHYDES

[75] Inventor: Thomas Karcher, Hofheim, Germany

[73] Assignee: Hoechst Aktiengesellschaft, Frankfurt, Germany

[21] Appl. No.: 515,911

[22] Filed: Aug. 16, 1995

[30] Foreign Application Priority Data

Aug. 16, 1994 [DE] Germany ..... 44 28 905.7

[51] Int. Cl.[6] ..... C25B 3/00

[52] U.S. Cl. ..... 205/448; 205/449; 205/455; 205/456; 205/460

[58] Field of Search ..... 205/448, 449, 205/455, 456, 460, 436; 204/72, 73 R, 74, 75, 76

[56] References Cited

U.S. PATENT DOCUMENTS 4,988,416 1/1991 Troupel et al. ..... 205/436

FOREIGN PATENT DOCUMENTS 0370866 5/1990 European Pat. Off. .
01119686 5/1989 Japan .

OTHER PUBLICATIONS

European Search Report No. 95112197.9, Nov. 21, 1995.
Derwent Publication, AN 89–182061 & JP–A–01 119 686 May 1989.

*Primary Examiner*—Arun S. Phasge
*Assistant Examiner*—Edna Wong
*Attorney, Agent, or Firm*—Connolly and Hutz

[57] ABSTRACT

The invention relates to a process for the electrosynthesis of an aldehyde of the formula (I)

$$R^1\text{—CHO} \qquad \text{(I)}$$

in which $R^1$ is an aryl or alkyl radical, by electrolysis of an organic halide of the formula (II)

$$R^1\text{—Hal} \qquad \text{(II)}$$

in which Hal is chlorine or bromine
and of an N,N-disubstituted formamide of the formula (III)

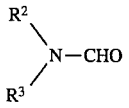

(III)

in which $R^2$ and $R^3$ are alkyl or aryl in a cell which is equipped with electrodes and has a chamber, the anode being self-consuming and being composed of a reducing metal, wherein the cathode is composed of lead.

14 Claims, No Drawings

PROCESS FOR THE ELECTROSYNTHESIS OF ALDEHYDES

The invention describes a process for the synthesis of aldehydes from the corresponding halides by electrolysis of the halides in the presence of N,N-disubstituted formamides.

Such a process has already been disclosed in EP 370 866, or U.S. Pat. No. 4,988,416.

In these patents, the halide is reacted with an N,N-disubstituted formamide electrolytically and the aminal produced is hydrolyzed under acid conditions:

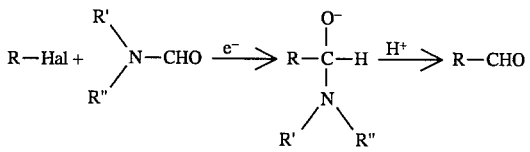

In this process, the anode is composed of a reducing metal, and the cathode of stainless steel, gold, nickel, platinum, copper, aluminum, iron or carbon. How the yields can be improved if the cathode is coated with an electrolytic deposit of a metal from the series comprising zinc, cadmium, lead or tin is described.

Several methods are specified for producing this metal-coated cathode from stainless steel or nickel, which methods have in common the fact that a $5\cdot10^{-2}$ to $10^{-1}$ molar solution of the corresponding metal salt is electrolyzed in DMF.

Zinc, cadmium, lead and tin compounds are cited as suitable salts.

In the examples, the zinc compounds and cadmium compounds are mainly used as metal salts, the highest yields being achieved with the cadmium compounds. The use of cadmium salts in industrial processes is ruled out because of the high toxicity, with the result that such a process cannot be carried out industrially. Tin, which is produced in the process electrolytically from the corresponding salts, is incompatible with the solvent DMF (Kühn-Birett, Instruction Sheets on Hazardous Substances, D 033), with the result that tin compounds cannot be used for industrial purposes either.

As Comparison Examples D1, D2 and D3 confirm, zinc salts have an unduly low product selectivity, which also decreases considerably in series experiments.

A procedure using lead salts in accordance with method C in U.S. Pat. No. 4,988,416 is represented by Comparison Examples B1 to B8. The conversion is 45 to 49.6% and the selectivity is between 38.2 and 43.9%, both of which make the process suitable for industrial purposes only to a limited extent. The important disadvantage of this process is, however, that it results in an appreciable discharge of lead salts via the electrolyte (B3: 2100, B6:1800 ppm of lead content). In the course of the working-up, this results in reaction residues which contain heavy metal and which are responsible for high waste-disposal costs and severely pollute the environment.

If the lead salt is added only in the first experiment in a series, the selectivity decreases markedly in the subsequent experiments (Comparison Experiments C1 to C3), with the result that this procedure is also unsuitable for industrial purposes.

In addition, aldehydes are frequently synthesized against the background of producing intermediates for the synthesis of active substances for plant protection and pharmaceutical preparations, with the result that it is essential to ensure in the course of the working-up that heavy-metal residues are removed without trace. From the point of view of quality assurance, therefore, such a process has to be assessed critically since expensive measures are necessary for trace analysis in order to rule out the danger that production batches contaminated with heavy metal enter a wider production process.

There was consequently a need for a process which avoids these disadvantages and makes it possible to carry out the electrolysis on an industrial scale and to obtain products without heavy-metal contamination.

This object is achieved by a process for the electrosynthesis of an aldehyde of the formula (I)

$$R^1\text{—CHO} \quad \text{(I)}$$

in which $R^1$ is an aryl or alkyl radical, by electrolysis of an organic halide of the formula (II)

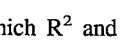

$$R^1\text{—Hal} \quad \text{(II)}$$

in which Hal is chlorine or bromine and of an N,N-disubstituted formamide of the formula (III)

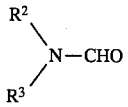

(III)

in which $R^2$ and $R^3$ are alkyl or aryl in a cell which is equipped with electrodes and has a chamber, the anode being self-consuming and being composed of a reducing metal, wherein the cathode is composed of lead.

It is advantageous if the anode is composed of magnesium, aluminum, zinc or an alloy thereof, in particular of magnesium.

In many cases, it has proved advantageous to use an N,N-disubstituted formamide in which $R^2$ and $R^3$ are $(C_1\text{–}C_2)$-alkyl or $R^2$ and $R^3$ form, together with the nitrogen, a 5- to 7-membered ring.

Particularly important is the process for preparing aldehydes in which $R^1$ is a substituted aryl radical; in this connection, for example, phenyl radicals substituted with $CF_3$ groups are interesting.

Good results are obtained if, in the process, the compound 5 of the formula (II) is used in a concentration of to 30% by weight, in particular 10 to 20% by weight, in the substituted formamide of the formula (III) as solvent.

It has been found advantageous to work at a reaction temperature of 10° to 50° C., in particular of 20° to 40° C.

In many cases it is expedient to carry out the process at current densities of 5 to 50 mA/cm$^2$, in particular 10 to 30 mA/cm$^2$, preferably 20 to 25 mA/cm$^2$.

Compared with the prior art, the process according to the invention (Experiment Series A) has the following advantages which are very important for industrial purposes:

- substantially lower voltage level for the same current level and reaction time, which results in lower energy costs (see Experiment Series A and Experiment Series B),
- a heavy-metal discharge via the electrolyte which is lower by a factor of 100 (lead content 21 or 22 ppm),
- substantially higher selectivity and consequently less formation of byproducts and markedly improved material balance,
- no reduction in space/time yield due to pretreatment of the electrodes as a result of electrolytic heavy-metal deposition.

EXAMPLE 1

Electrolysis cell:

Glass pot cell having a circular lead base plate which also serves as cathode (diameter 6.7 cm). Situated concentrically above the base plate is a magnesium cylinder (diameter 5.5 cm, height approximately 20 mm) which acts as sacrificial anode. The anode is contacted and held by means of a rod of V to A steel which is passed through the cell lid and screwed into the anode.

The spacing between anode and cathode is approximately 10 mm. The cell body is of glass and has a cooling jacket. The entire gas space of the electrolysis cell is overlaid with nitrogen. The reaction material is mixed by magnetic stirring.

From all the experiments, a sample was hydrolyzed in each case with dilute hydrochloric acid and then extracted with a low-boiling hydrocarbon. This extract was analyzed by gas chromatography.

Definition of terms:

Conversion=100–[surface percentage of residual educt]

Selectivity=[surface percentage of product]/[conversion] 100%

Note: Since experiments identical in reaction volume and procedure are compared, a calibration for the purpose of quantitative determination is not necessary.

Vc1=cell voltage at the start of the experiment Vcmin= minimum cell voltage in the course of the experiment Vcend=cell voltage at the end of the experiment Pb-dis.=lead content of the electrolyte subsequent experiments without cleaning of the reactor Series A 80 ml of DMF, 400 mg of $Bu_4NBF_4$, 18.1 g of 4-chlorobenzotrifluoride 20 mA/cm$^2$/Pb cathode/room temperature

| Experiment | Vc1 [V] | Vcmin [V] | Vcend [V] | Conversion % | Selectivity % | Pb-dis. |
|---|---|---|---|---|---|---|
| A1 | 48.0 | 12.5 | 15.4 | 81.5 | 49.7 | |
| A2 | 30.2 | 14.0 | 16.5 | 82.1 | 66.0 | |
| A3 | 35.6 | 15.2 | 17.6 | 78.7 | 65.6 | 21 ppm |
| A4 | 35.2 | 16.9 | 19.5 | 78.3 | 71.5 | |
| AS | 44.4 | 21.7 | 26.2 | 83.7 | 75.2 | |
| A6 | 51.6 | 20.4 | 25.5 | 84.4 | 72.7 | 22 ppm |
| A7 | 48.5 | 13.6 | 15.5 | 85.9 | 72.0 | |
| A8 | 32.2 | 15.3 | 18.3 | 85.8 | 67.2 | |
| Mean | 40.7 | 16.2 | 19.3 | 82.6 | 67.5 | |
| St. dev. | 8.3 | 3.3 | 4.3 | 2.9 | 8.0 | |

Pb: lead content determined by flame atomic absorption

Series B 80 ml of DMF, 100 mg of $Bu_4NBF_4$, 900 mg of $PbBr_2$, 18.1 g of 4-chlorobenzotrifluoride 20 mA/cm$^2$/VA cathode/room temperature

| Experiment | Vc1 [V] | Vcmin [V] | Vcend [V] | Conversion % | Selectivity % | Pb-dis. |
|---|---|---|---|---|---|---|
| B1 | 25.0 | 27.5 | 41.2 | 46.9 | 42.2 | |
| B2 | 31.3 | 29.6 | 45.8 | 45.4 | 41.3 | |
| B3 | 29.3 | 27.2 | 42.5 | 45.1 | 38.2 | 2100 ppm |
| B4 | 27.7 | 27.3 | 41.3 | 46.0 | 40.0 | |

-continued

| Experiment | Vc1 [V] | Vcmin [V] | Vcend [V] | Conversion % | Selectivity % | Pb-dis. |
|---|---|---|---|---|---|---|
| B5 | 23.6 | 23.6 | 39.4 | 49.6 | 43.9 | |
| B6 | 27.1 | 26.6 | 38.0 | 47.1 | 42.5 | 1800 ppm |
| B7 | 23.1 | 23.1 | 38.9 | 45.0 | 40.8 | |
| B8 | 28.0 | 25.8 | 37.0 | 43.4 | 41.5 | |
| Mean | 26.9 | 26.3 | 40.5 | 46.1 | 41.3 | |
| St. dev. | 2.8 | 2.1 | 2.8 | 1.8 | 1.7 | |

Series C

Room temperature VA cathode

In the first experiment, 80 ml of DMF, 258 mg of $Bu_4NBr$ and 1468 mg of $PbBr_2$ are taken and electrolyzed for one hour 10 min at 5 mA/cm$^2$. Then 18.1 g of 4-chlorobenzotrifluoride are added and the current density is raised to 20 mA/cm$^2$.

In the subsequent experiments the renewed addition of $PbBr_2$ is dispensed with and the current density is 20 mA/cm$^2$ from the start. 4-Chlorobenzotrifluoride is also taken from the start.

| Experiment | Vc1 | Vcmin | Vcend | Conversion | Selectivity |
|---|---|---|---|---|---|
| C1 | 15.7* | 12.8* | 17.0* | 88.7 | 84.6 |
| C2 | 34.6 | 21.0 | 25.6 | 82.8 | 70.3 |
| C3 | 52.8 | 21.5 | 33.1 | 79.3 | 63.4 |

*Voltage values referred to a phase of the experiment run at 20 mA/cm$^2$ per phase Series D Procedure analogous to Series C First experiment 80 ml of DMF, 258 mg of $Bu_4NBr$, 544 mg of $ZnCl_2$ 70 min at 5 mA/cm$^2$, then addition of 18.1 g of 4-chlorobenzotrifluoride and increase to 20 mA/cm$^2$.

In the subsequent experiments, the renewed $ZnCl_2$ addition is dispensed with. The 4-chlorobenzotrifluoride is taken from the start.

| Experiment | Vc1 [V] | Vcmin [V] | Vcend [V] | Conversion | Selectivity |
|---|---|---|---|---|---|
| D1 | 18.0* | 18.0* | 50.9* | 60.6 | 42.8 |
| D2 | 33.6 | 33.6 | 45.2 | 49.0 | 35.8 |
| D3 | 49.5 | 37.2 | 43.1 | 45.4 | 23.6 |

*Voltage values referred to a phase of the experiment run at 20 mA/cm$^2$

I claim:

1. A process for the electrosynthesis of an aldehyde of the formula (I)

$$R^1\text{—CHO} \quad (I)$$

in which $R^1$ is an aryl or alkyl radical, comprising the step of:

electrolyzing an organic halide of the formula (II)

$$R^1\text{—Hal} \quad (II)$$

in which Hal is chlorine or bromine and an N,N-disubstituted formamide of the formula (III)

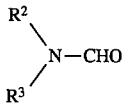

(III)

in which $R^2$ and $R^3$ are alkyl or aryl in a cell equipped with cathodic and anodic electrodes and that has a chamber, wherein the anode is self-consuming and comprises a reducing metal, and the cathode consist of lead.

2. The process as claimed in claim 1, wherein the anode is magnesium, aluminum, zinc or an alloy thereof.

3. The process as claimed in claim 1, wherein $R^2$ and $R^3$ are $(C_1-C_2)$-alkyl or form, together with the nitrogen, a 5- to 7-membered ring.

4. The process as claimed in claim 1, wherein $R^1$ is a substituted aryl radical.

5. The process as claimed in claim 1, wherein $R^1$ is a phenyl radical which is substituted with a $CF_3$ group.

6. The process as claimed in claim 1, wherein the compound of the formula II is used in a concentration of 5 to 30% by weight, in the substituted formamide of the formula III as solvent.

7. The process as claimed in claim 1, wherein the reaction temperature is 10° to 50° C.

8. The process as claimed in claim 1, wherein the process is carried out at current densities of 5 to 50 $mA/cm^2$.

9. The process as claimed in claim 1, wherein the anode is magnesium.

10. The process as claimed in claim 1, wherein the compound of the formula II is used in a concentration of 10 to 20% by weight in the substituted formamide of the formula III as solvent.

11. The process as claimed in claim 1, wherein the reaction temperature is 20° to 40° C.

12. The process as claimed in claim 1, wherein the process is carried out at current densities of 10 to 30 $mA/cm^2$.

13. The process as claimed in claim 1, wherein the process is carried out at current densities of 20 to 25 $mA/cm^2$.

14. The process as claimed in claim 1, wherein the electrolyzing occurs in an electrolyte solution and wherein upon completion of the process the lead content of the electrolyte solution as measured by flame atomic absorption is below 30 ppm.

* * * * *